United States Patent [19]

Halfacre

[11] Patent Number: 4,852,751

[45] Date of Patent: Aug. 1, 1989

[54] TAMPER INDICATING CONTAINER-CLOSURE PACKAGE

[75] Inventor: J. Wayne Halfacre, Iuka, Ill.

[73] Assignee: Sunbeam Plastics Corporation, Evansville, Ind.

[21] Appl. No.: 198,434

[22] Filed: May 25, 1988

[51] Int. Cl.[4] ..... B65D 1/02

[52] U.S. Cl. ..... 215/32

[58] Field of Search ..... 215/32, 252, 253, 256; 220/276, 266

[56] References Cited

U.S. PATENT DOCUMENTS

| | | | |
|---|---|---|---|
| 3,716,162 | 2/1973 | Botkin | 220/266 X |
| 3,815,770 | 6/1974 | Guala | 215/253 |
| 3,817,420 | 6/1974 | Heisler | 220/276 X |
| 3,904,062 | 9/1975 | Grussen | 215/252 |
| 3,920,503 | 11/1975 | Keeler | 156/580 |
| 4,024,976 | 5/1977 | Acton | 215/32 |
| 4,111,325 | 9/1978 | Bellamy | 215/232 |
| 4,371,088 | 2/1983 | Gach | 215/220 |
| 4,446,979 | 5/1984 | Gach | 215/203 |
| 4,567,991 | 2/1986 | Anderson | 215/216 |
| 4,570,810 | 2/1986 | Hawkins | 215/253 |
| 4,572,387 | 2/1986 | Luker et al. | 215/252 |
| 4,572,389 | 2/1986 | Gach | 215/250 |
| 4,603,785 | 8/1986 | Gach | 215/230 |
| 4,610,371 | 9/1986 | Karkiewicz | 220/260 |
| 4,643,321 | 2/1987 | Gach | 215/252 |
| 4,682,702 | 7/1987 | Gach | 215/232 |
| 4,711,372 | 12/1987 | Gach | 222/23 |

FOREIGN PATENT DOCUMENTS 520898 7/1968 U.S.S.R. .

*Primary Examiner*—Donald F. Norton

*Attorney, Agent, or Firm*—Gifford, Groh, Sheridan, Sprinkle and Dolgorukov

[57] ABSTRACT

A tamper indicating package in which the tamper indicating element is located on the container neck. A satellite ring is integrally molded with the container neck being connected thereto by a frangible connection between the ring and an integrally molded container neck flange. The frangible connection is broken to remove the closure from the container neck. Standard caps can be used on the container.

14 Claims, 1 Drawing Sheet

TAMPER INDICATING CONTAINER-CLOSURE PACKAGE

This invention relates to tamper indicating container-closure packages, and more particularly to packages where the tamper indicator is molded integrally with the container.

There are a wide variety of tamper indicating container-closure packages available which are designed to indicate to a prospective purchaser whether or not the original package has been tampered or at least when an attempt has been made to open the package. Substantially all of these packages rely upon the fracture or removal of an element of the closure. Some packages rely upon a permanent change of the appearance of the closure effected by an initial opening movement without a fracture or removal of a portion of the closure. Most of the packages rely upon a coaction between the closure and a stop or lug on the container neck to produce the indication.

One of the more popular tamper indicating closures utilizes a tamper indicating band which is connected to the bottom of the cap skirt by a frangible connection. The frangible connection usually takes the form of a number of of evenly spaced frangible webs extending between the bottom of the cap and the top of the band. The band usually has an inwardly projecting bead at its bottom which cooperates with a stop in the form of a flange or undercut on the container neck, commonly known as a snap bead connection, which prevents the band from moving when the cap is turned in an unthreading direction. This causes the frangible webs to break in tension upon initial opening movement of the cap. The band remains with the container neck indicating the prior opening or tampering of the package. The bead on the bottom of the tamper indicating band can be continuous or segmental. Another variation of this closure is to provide ratchet teeth on the bottom of the tamper indicating band which coact with similar stops or ratchet teeth on the container neck that prevent rotation of the band during the initial unthreading of the cap, causing failure of the webs in torsion.

Since at least some of the closures with tamper indicating bands experienced premature failure of the frangible connection in the filling and capping process, there have been a number of closures introduced with open bottom tamper indicating bands in which the retaining bead is formed on the band after capping by the use of heat or a mechanical roller or both to form an inwardly directed bead which cooperates with a container neck flange.

Still further versions of closures with tamper indicating bands utilize a separate tamper indicating band which is mechanically snapped onto the cap skirt or welded thereto. This simplifies the base cap design and minimizes the problem of frangible web breakage in the capping process.

A variation of a closure having a tamper indicating band depending from the bottom of the cap skirt is one in which the band is formed as a tear strip, so that the user grabs a tab on the strip to remove the band breaking the frangible webs in the process.

Other types of tamper indicating closures utilize multiple parts, such as an outer and inner cap in which the inner cap takes the form of a stopper which seats in the container neck, and the outer cap is a driver which exerts opening and closing force on the inner cap as it seats on the container neck. Upon the initial movement of the outer cap in a opening direction, it is permanently displaced. The outer cap is transparent and it displays a message indicating the original package integrity before initial opening is attempted and an "opened" message upon initial movement. The initial movement may partially obliterate the initial indication t indicate tampering or opening. Once the outer cap has been moved in this initial opening, the outer cap remains stationary with respect to the inner cap. Another type of closure using an inner and outer cap also provides a child resistant feature requiring a sequential pushing and turning movement, and the tamper indication is provided by an element extending between the inner and outer caps which is broken by the initial depression of the outer cap to engage the inner cap for opening.

Another version of a tamper indicating closure utilizes a membrane formed integrally over the dispensing orifice which is removed by lifting a pull ring to tear the membrane as a disc or tear strip from the dispensing orifice. It is also common to apply a foil or plastic seal over the mouth of the container neck either by an adhesive, or a heat sealing process after the closure has been applied to the container neck.

Another type of tamper indicating closure utilizes a satellite ring which surrounds a substantial portion of the cap skirt and is connected thereto by a frangible connection. Once the cap has been applied to the container by high speed capping machinery which engages the top of the cap, the user cannot remove the cap without breaking the frangible connection between the ring and cap skirt.

In the case of dispensing closures where a separate lid is hinged to the base cap, frangible connections have been introduced between the lid and base cap which are broken upon initial opening. Another improvement of this design utilizes a tamper indicating disc which is attached to the base cap by a barbed pin passing through the lid into the base cap.

Another technique to provide tamper indication and to seal the closure to the container has been to weld the two together after initial capping so that initial opening creates a deformation or fracture of the closure to indicate tampering.

In all of the foregoing, the tamper indicating is provided by deformation or fracture occuring on the closure. The principle object of this invention is to provide the tamper indicating element as an integral part of the container. This allows the use of standard types of closures with little or no possibility of failure of a frangible connection occurring upon application of the closure to the container neck.

The principle objective of this invention is accomplished in a tamper indicating container-closure package in which the container has a tamper indicating element integrally molded to the container neck by a frangible connection. The frangible connection is broken during the initial removal of the closure from the container neck.

The container neck has a conventional means for attaching the closure to it, such as internal or external threads or an internal or external surface which the base of the closure can engage as an internal plug or external cap with or without the use of additional retention beads or undercuts which engage complementary elements on the closure cap. An outwardly directed flange is integrally molded on the container neck below the conventional attachment means, and a satellite ring is also integrally molded with the container neck by attachment to the container flange with a frangible connection. The frangible connection can take the form of a continuous circumferential web or line of weakening or a series of equally spaced frangible webs. The satellite ring extends upwardly from the container flange to prevent removal of the cap from the container neck without fracture of the frangible connection thus indicating tamper or initial opening of the cap on the container neck.

In one embodiment, the satellite ring extends over a substantial portion of the height of the cap, so that the frangible connection must be broken in order to grip the cap skirt to remove the closure from the container neck.

In another embodiment, the satellite ring has an inwardly projecting flange at its top which overlies an outwardly projecting flange at the bottom of the cap skirt so that initial movement of the cap such as unthreading will break the frangible connection.

The objects of this invention are accomplished by the embodiments disclosed in the following description and illustrated in the drawing in which.

Figure 1:
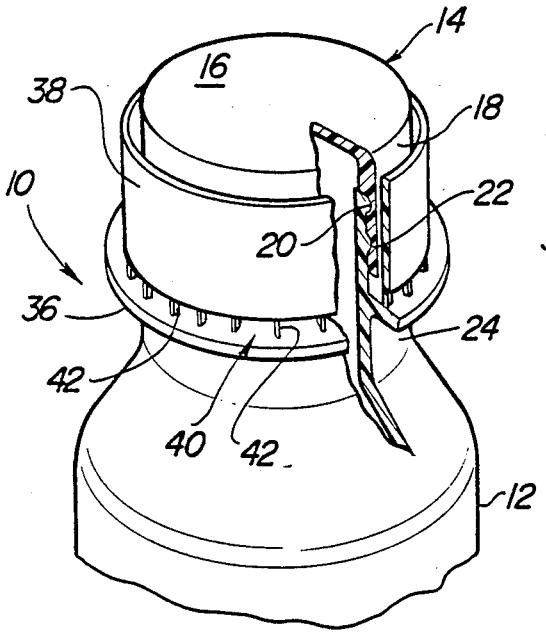
FIG. 1 is a perspective view of the container-closure package of this invention with a portion broken away showing a flange integrally molded with the container neck mounting a satellite ring attached thereto by frangible webs.
Figure 2:
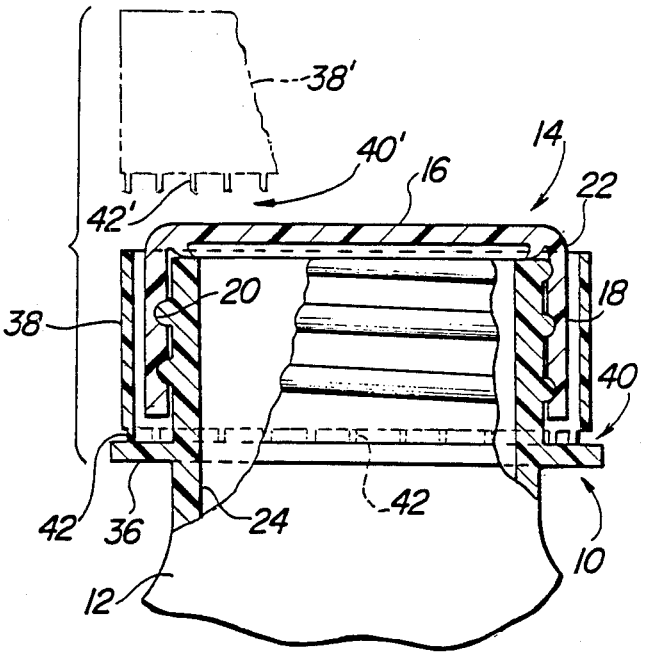
FIG. 2 is an elevational view, partially in section showing the invention of FIG. 1 in further detail and showing in phantom the satellite ring fractured away from the container flange.
Figure 3:
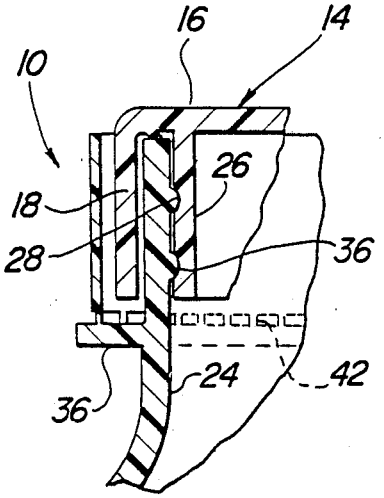
FIG. 3 is a partial elevational view in section showing another embodiment of the invention.
Figure 4:
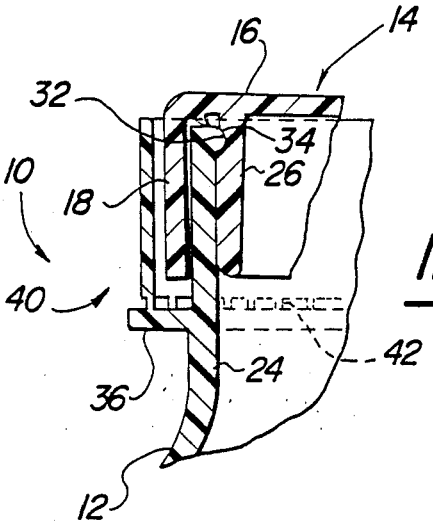
FIG. 4 is a partial elevational view in section showing another embodiment of the invention.

Referring to the drawing, the tamper indicating package 10 of the invention is shown as including container 12 and closure 14. Closure 14 takes the form of a standard cap having a substantially planar top 16 and an annular skirt 18 depending from the periphery of top 16. In the embodiments shown in FIGS. 1, 2 and 5, cap skirt 18 has internal threads 20 which engage external threads 22 on container neck 24. In the embodiment of FIG. 3, base cap 14 has an inner skirt 26 concentric with annular skirt 18 provided with external threads 28 which engage internal threads 30 on container neck 24. In the embodiment of FIG. 4, inner skirt 26 engages the interior of container neck 24 and is provided with an undercut 32 which engages a bead 34 on the interior of container neck 24.

Container neck 24 is provided with an integrally molded outwardly extending flange 36 below the container threads or snap bead. Satellite ring 38 is integrally molded with container 12 being attached to neck flange 36 by a frangible connection 40 taking the form of a plurality of equally spaced frangible webs 42. In the embodiments of FIGS. 1–4, the satellite ring 38 extends upwardly from flange 36 to shield or cover a substantial portion of the height of closure 14. Frangible connection 42 must be broken to remove the satellite ring 38 in order to grip the cap skirt 18 for removal of the closure 16. FIG. 2 shows in phantom the satellite ring 38' as it has been removed after fracture of frangible webs 42' which constitute the frangible connection 40'.

Figure 5:
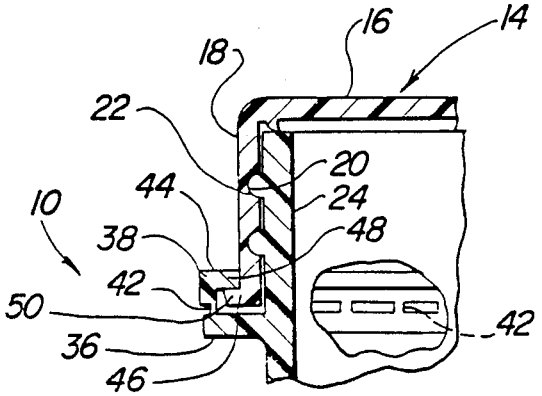
FIG. 5 is a partial elevational view in section showing still another embodiment of the invention.

In the embodiments shown in FIG. 5, the satellite ring 38 extends upwardly only a short distance terminating in an inwardly directed flange 44 which overlies an outwardly directed flange 46 at the bottom of cap skirt 18. When the cap skirt 18 is grasped and turned in a unthreading direction, cap flange 46 will engage satellite ring flange 44, breaking the frangible webs 42 to indicate tampering or initial opening. Satellite ring flange 44 can be provided with an internal ramp surface 48 which engages a complementary ramp surface 50 on the cap skirt flange 46 to assist in moving cap skirt flange 46 past satellite ring 44 in the initial threading on process to insure that the frangible webs 42 are not broken. Additionally, the satellite ring 38 may be segmented in this embodiment to further aid in assembly of the closure 16 to the container neck 24.

I claim:

1. A tamper indicating container-closure package comprising, in combination:

a container having a neck with means for attaching a closure thereto;

a satellite ring attached to said container neck with a frangible connection below said closure attaching means; and a closure cap having a top and an annular skirt depending from said top with attaching means complementary to said container attaching means;

said satellite ring extending over a substantial height of said annular skirt and preventing gripping of said annular skirt for removal of said cap from said container neck without fracture of said frangible connection and removal of said ring thereby indicating tampering or initial opening of said cap on said container neck.

2. The tamper indicating package according to claim 1 including a flange located on said container neck below said closure attachment means and said frangible connection being located between said flange and the bottom of said satellite ring.

3. The tamper indicating package according to claim 2 wherein said frangible connection includes a plurality of frangible webs extending between said container flange and the bottom of said satellite ring.

4. The tamper indicating package according to claim 1 wherein said cap skirt and container neck have complementary threads for attaching said cap to said container neck, and said frangible connection must be broken to allow said cap to be unthreaded from said container neck.

5. The tamper indicating package according to claim 1 wherein said cap skirt engages the internal diameter of the container neck as a plug to comprise the complementary attaching means on said cap skirt and container neck, said closure further having an outer skirt concentric with said cap skirt and said satellite ring concentrically surrounds a substantial portion of said outer skirt so that said frangible connection must be broken to permit gripping the outer skirt for removal of said closure from said container neck.

6. The tamper indicating package according to claim 5 wherein said complementary attaching means on said cap skirt includes an undercut thereon which engages a snap bead on the inside diameter of said container neck.

7. A tamper indicating container-closure package comprising, in combination:

a container having a threaded neck and an outwardly directed flange on said container neck below said threads;

an upwardly extending satellite ring integrally molded on said container neck by a plurality of evenly spaced frangible webs connected to said flange; and a closure cap having a top and an annular skirt depending from the periphery of said to, and threads for engagement with said container neck threads;

said satellite ring extending over a substantial portion of the height of said cap to obstruct gripping of said skirt and preventing removal of said cap from said container neck until said frangible connection is broken and said satellite ring is displaced so that gripping force can be applied to said annnular skirt for unthreading, thereby indicating tampering or initial opening of said cap on said container neck.

8. The tamper indicating package according to claim 7 wherein said container neck has external threads and said cap skirt has complementary internal threads.

9. A tamper indicating container-closure package comprising, in combination:

a container having a neck with means for attaching a closure thereto;

an outwardly extending flange integrally molded on said container neck below said attaching means;

an upwardly extending satellite ring integrally molded on said container neck by a plurality of evenly spaced frangible webs connected to said flange; and a closure cap having a top and an annular outer skirt depending from the periphery of said top, and an inner skirt concentric with said outer skirt depending from said cap top and having attaching means complementary to said container attaching means;

said satellite ring extending over a substantial portion of the height of said cap preventing removal of said cap from said container neck until said frangible connection is broken and gripping force can be applied to said annular outer skirt for removal of said closure, thereby indicating tampering or initial opening of said cap on said container neck.

10. The tamper indicating package according to claim 9 wherein said inner skirt is proportioned to be a plug for engaging the inside diameter of said neck for attaching said closure to said container.

11. The tamper indicating package according to claim 10 wherein said complementary attaching means on said cap skirt further includes an undercut thereon which engages a snap bead on the inside diameter of said container neck.

12. The tamper indicating package according to claim 9 whereins said container neck is internally threaded and said inner skirt has complementary external threads for attaching said closure to said container.

13. A tamper indicating container-closure package comprising, in combination:

a container having an internally threaded neck;

a satellite ring attached to said container neck with a frangible connection below said closure attaching means;

a closure cap having a top and an annular skirt depending from said top with external threads complementary to said container threads;

said closure having an outer skirt concentric with said cap skirt, said satellite ring concentrically surrounding a substantial portion of said outer skirt so that said frangible connection must be broken to permit gripping of said outer skirt for unthreading of said closure from said container neck.

14. A tamper indicating container-closure package comprising, in combination:

a container having a threaded neck and an outwardly directed flange on said container neck below said threads;

an upwardly extending satellite ring integrally molded on said container neck by a plurality of evenly spaced frangible webs connected to said flange; and a closure cap having a top and an annular skirt depending from the periphery of said top, and threads for engagement with said container neck threads;

said satellite ring extending over a substantial portion of the height of said cap to obstruct gripping of said skirt preventing removal of said cap from said container neck until said frangible connection is broken and said satellite ring is displaced so that gripping force can be applied to said annular skirt for unthreading, thereby indicating tampering or initial opening of said cap on said container neck.

* * * * *